United States Patent [19]

Kii

[11] 4,273,977

[45] Jun. 16, 1981

[54] CIRCUIT INTERRUPTER

[75] Inventor: Masami Kii, Amagasaki, Japan

[73] Assignee: Mitsubishi Denki Kabushiki Kaisha, Tokyo, Japan

[21] Appl. No.: 933,532

[22] Filed: Aug. 14, 1978

[30] Foreign Application Priority Data

| | | | |
|---|---|---|---|
| Aug. 31, 1977 | [JP] | Japan | 52-105165 |
| Aug. 31, 1977 | [JP] | Japan | 52-105166 |
| Aug. 31, 1977 | [JP] | Japan | 52-105167 |
| Aug. 31, 1977 | [JP] | Japan | 52-105168 |

[51] Int. Cl.[3] ..... H01H 9/44; H01H 33/18

[52] U.S. Cl. ..... 200/147 R; 200/148 A; 200/148 B

[58] Field of Search ..... 200/144 A, 146 R, 146 A, 200/147 R, 148 A, 148 J, 150 G

[56] References Cited

U.S. PATENT DOCUMENTS

| | | | |
|---|---|---|---|
| 3,551,625 | 12/1970 | Fischer | 200/148 A |
| 3,590,191 | 6/1971 | Kind et al. | 200/147 R X |
| 3,665,134 | 5/1972 | Fischer | 200/148 A |
| 4,046,979 | 9/1977 | Hertz et al. | 200/148 A |

*Primary Examiner*—James R. Scott

*Attorney, Agent, or Firm*—Oblon, Fisher, Spivak, McClelland & Maier

[57] ABSTRACT

A circuit interrupter consisting of a pair of contacts being relatively movable to be detachable in an arc extinct chamber filled with a fluid for arc extinction is disclosed. Also included are a chamber for storing the fluid pressurized in an arc space in which the arc is formed by the departing operation of the contacts and means for forming magnetic field in the arc space. The fluid for arc extinction is discharged from said chamber by opening a passage after departing the contacts for a specific distance and the arc is interrupted by puffing the fluid.

7 Claims, 7 Drawing Figures

CIRCUIT INTERRUPTER

BACKGROUND OF THE INVENTION

1. Field of the Invention

The present invention relates to a circuit interrupter wherein an arc is interrupted by puffing a fluid for arc extention e.g. $SF_6$ gas and more particularly, it relates to a self-arc extinction type circuit interrupter in which high pressure fluid pressurized by the arc formed between contacts, is used for performing the arc extinction.

2. Description of the Prior Arts

In the conventional circuit interrupters, a fluid in a suitable volumetric space is pressurized by the pressurizing function of arc energy transmitted from the arc to the fluid filled in the space and on the other hand, the pressurized fluid is released from an opening closed by the arc through the arc space under periodical changes of the arc current to cause a sudden decrease of arc energy in the decreasing step and to decrease a diameter of the arc whereby the arc extinction is attained by the resulting puffing and cooling effect to the arc fluid in the arc space.

In such a self-arc extinction type circuit interrupter, it is important to maintain the pressure. The pressure is dependent upon the arc energy. Accordingly, the maintenance of the pressure is relatively easy in the zone of large arc current. However, in the zone of small arc current, the arc energy is remarkably small and the pressurizing effect is low whereby the maintenance of the pressure required for the arc extinction is not easy. Accordingly, a zone of remarkably small arc extinct effect is found.

This disadvantage sets off the advantageous characteristics in the large arc current zone and moreover the arc is disadvantageously extended to a high voltage zone.

SUMMARY OF THE INVENTION

It is an object of the present invention to overcome these disadvantages and to provide a circuit interrupter wherein the characteristic in the large current zone is further improved without deterioration of stable and other characteristics by a compact and simple structure and an economical operation under excellent characteristics of the self-arc extinction type circuit interrupter.

It is the other object of the present invention to apply a DC magnetic field to an arc formed between the contacts whereby the arc is extended in zig-zag and curved form to be longer than the distance between the contacts and the pressurizing effect by the arc is improved and the arc is swung by the alternative property of the AC arc and the reverse shifting force for reversing each alternation of the arc current formed in the DC magnetic field to give high arc extinguishing effect.

The other object of the present invention to provide a circuit interrupter having improved characteristics in compact size wherein an arc shifting force is formed by a stable DC magnetic field and it is applied at the same time as forming the arc to effectively stably apply the arc shifting force without any phase adjusting means required in an AC magnetic field and to give excellent characteristics in all ranges of the arc current.

The other object of the present invention is to provide a circuit interrupter having stable and excellent characteristics in all ranges of the arc current in compact size having less movable parts to be highly economical and practical, wherein the arc extinguishing effect is increased by effects of the discharged fluid with synergistic effects of the magnetic field effects for improving the pressurizing effect and uniforming the temperature in the space.

The other object of the present invention is to provide a circuit interrupter having excellent characteristics in all ranges of the arc current without any deterioration of excellent characteristics of the self-arc extinction type circuit interrupter wherein magnetic fields turning to alternatively opposite directions to the axial direction of the arc formed between the contacts and the arc is turned and extended in zig-zag form to extend the arc length rapidly over the distance between the contacts and the puffing effect of the fluid is improved.

DETAILED DESCRIPTION OF THE EMBODIMENTS

Figure 1:
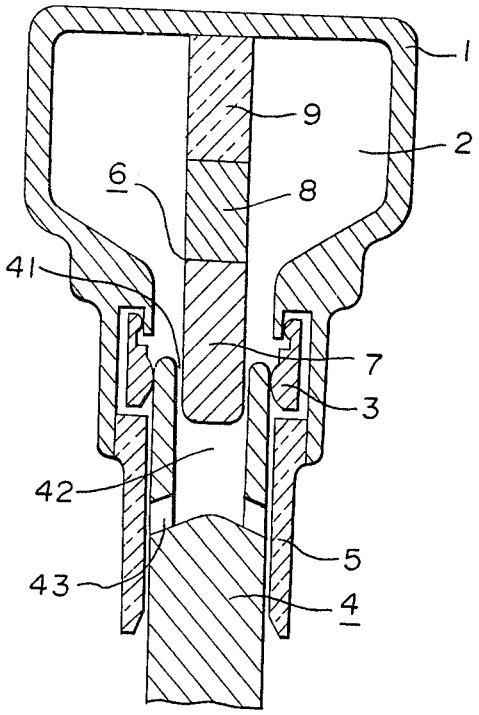
FIG. 1 is a sectional view of an important part of one embodiment of the circuit interrupter of the present invention.

Referring to the drawings, certain embodiments of the present invention will be illustrated.

In FIG. 1, the reference numeral (1) designates a body of the circuit interrupter equipped in a container (not shown) filled with a fluid for arc extinction e.g. $SF_6$ gas, and (2) designates a chamber which stores the fluid for arc extinction and has suitable volumetric space for temporarily storing the pressurized fluid formed by a pressurizng effect of arc; (3) designates a fixed contact disposed in the body (1); (4) designates a movable contact which is disposed to be detachable to the fixed contact (3) and which comprises an inlet (41) for the fluid, a passage (42) and an outlet (43); (5) designates a surrounding shell made of an insulating material which is connected to the body (1) so as to surround the movable contact (4) and which forms a nozzle and an arc space in it; (6) designates means for forming magnetic field which is disposed in concentricity to the fixed contact (3) in the form extending into the arc space. For example, the means for forming magnetic field comprises a magnetic induction member (7) and a magnetizing member (8) (permanent magnet or DC magnetic field forming device) which are held by an insulating supporter (9) on the inner part of the body of the circuit interrupter.

Figure 2:
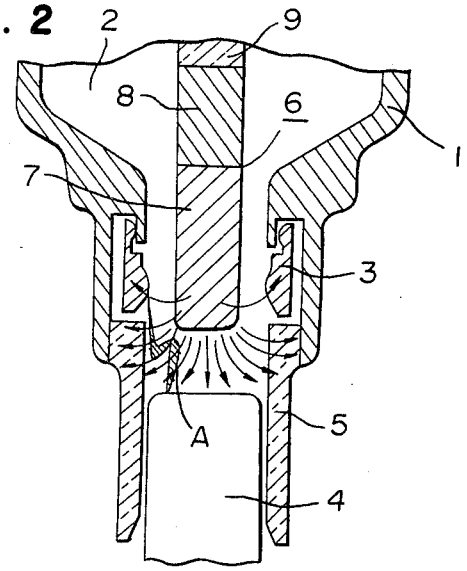
FIG. 2 is a sectional view of the important part for illustrating the operation of the circuit interrupter of FIG. 1.

In said structure of the embodiment, the departing instruction is given to a driving device (not shown) and the driving device starts the operation to descend the movable contact (4) interlocked to the driving device. The movable contact (4) descends for a wiping distance to the fixed contact (3), (4) whereby the arc is formed and the part is in the closing condition by the arc. As shown in FIG. 2, the magnetic field in a specific polarity (the arrow line) is formed by the means for forming magnetic field (magnetizing device) (6) in the arc space. The arc A formed in the arc space is shifted to the direction depending upon the arc current direction and magnetic field polarity direction.

The arc current is periodically varied to be zero and the arc current is reversed in the next half period. The magnetic field direction is not changed whereby the arc shifting force is instantaneously reversed at the zero of the arc current. The arc is transversely swung in every half period of the arc current period and the position of the arc is changed in every half period to form new arc locus. When the movable contact (4) descends further, the arc input is increased by the swing and extension effect of the arc even in a small arc current range, whereby the pressurizing effect in the chamber (2) is accelerated.

When the movable contact (4) descends further, the condition of the chamber (2) is changed to the condition releasing the pressure through passage (42) and the outlet (43). In the next time decreasing the arc current to zero, the arc is extinguished by severe arc extinct effect under both of the magnetic effect to the arc and the puffing and cooling effect of the fluid discharged.

The arc swing effect results in the uniform temperature distribution in the arc space to decrease the highest temperature whereby the puffing effect of the arced fluid is improved and satisfactory arc extinct effect is resulted with a relatively lower pressurizing source. Accordingly, a circuit interrupter having stable characteristic and less movable parts and high practical value in smaller size and lower pressure resistant structure can be obtained.

The magnetic field distribution in the arc space can be easily changed depending upon a shape of the magnetic inductance member (6) at the lower end.

Figure 3:
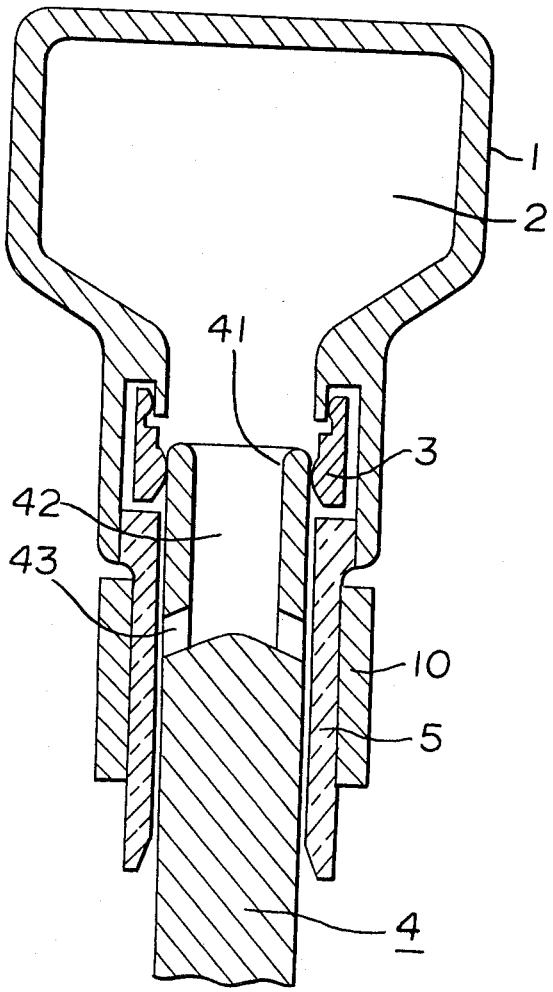
FIG. 3 is a sectional view of an important part of a second embodiment of the present invention.

The second embodiment of the present invention is shown in FIG. 3.

In FIG. 3, the reference numeral (1) designates a body of the circuit interrupter equipped in a contained (not shown) filled with a fluid for arc extinction e.g. $SF_6$ gas and (2) designates a chamber which stores the fluid for arc extinction and has suitable volumetric space for temporarily storing the pressurized fluid formed by a pressurizing effect of arc; (3) designates a fixed contact disposed in the body (1); (4) designates a movable contact which is disposed to be detachable to the fixed contact (3) and which comprises an inlet (41) for the fluid, a passage (42) and an outlet (43); (5) designates a surrounding shell made of an insulating material which is connected to the body (1) so as to surround the movable contact (4) and which forms a nozzle and an arc space in it; (10) designates one or more magnetic members which are disposed around the surrounding shell (5) to form a magnetic field in the arc space, and suitable magnetic field distribution (intensity and direction) is given in the arc space to extend the arc in zig-zag form and the arc shifting force resulted in each reverse of the arc current is applied at the time most effective for the arc extinction near the zero of the arc current. The magnetic member (10) can be disposed in the circumferencial direction as well as the axial direction. That is, the magnetic member (10) can be disposed to give magnetic field components in cross distribution to the circumferencial and axial direction to the arc line.

In said structure of the embodiment, the departing instruction is given to a driving device (not shown) and the driving device starts the operation to descend the movable contact (4) interlocked to the driving device. The movable contact (4)descends for a wiping distance to the fixed contact (3) to detouch the contacts (3), (4) whereby the arc is formed and the part is in the closing condition by the arc.

The movable contact (4) descends further to extend the arc in the surrounding shell (5), and the pressure in the chamber (2) is raised by the arc. The inner part of the surrounding shell (5) is magnetized by the magnetic member (10) whereby the arc is extended under various arc shifting forces in various intensities and directions (zig-zag, curve, turn and field sharing etc.) depending upon the magnetic field distribution of the arc. The direction of the magnetic field in the arc space is not variable by a DC magnetic field or magnet field, but the arc current is periodically varied whereby the direction of the arc shifting force is changed in each half period depending upon the variation of the arc current. All of the arc shifting force applied for the arc is reversed in each time to be zero of the arc current. At this time, the highest magnetic shear force and a swing effect are applied for the entire length of the arc. During the arc shifting effect, the arc pressurizing effect is continuously applied and is improved by the magnetic field effect whereby the pressure required for the arc extinction in the chamber (2) is easily and rapidly given even though the arc current is small.

When the movable contact (4) descends further, the pressurized fluid in the chamber (2) is discharged through the outlet (43). In the next time decreasing the arc current to zero, the arc is extinguished by both of the magnetic effect of the arc and the severe puffing and cooling effects caused by releasing the pressurized fluid in the chamber (2).

Figure 4:
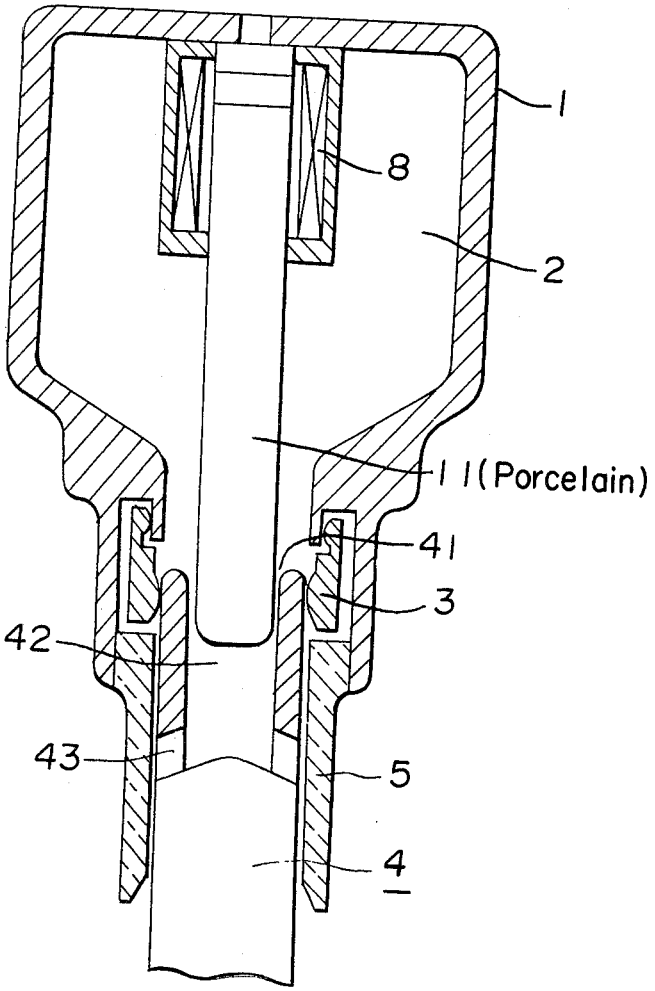
FIG. 4 is a sectional view of an important part of a third embodiment of the present invention.

The third embodiment of the present invention is shown in FIG. 4.

In FIG. 4, the reference numeral (1) designates a body of the circuit interrupter equipped in a container (not shown) filled with a fluid for arc extinction e.g. $SF_6$ gas and (2) designates a chamber which stores the fluid for arc extinction and has suitable volumetric space for temporarily storing the pressurized fluid formed by a pressurizing effect of arc; (3) designates a fixed contact disposed in the body (1); (4) designates a movable contact which is disposed to be detachable to the fixed contact (3) and which comprises an inlet (41) for the fluid, a passage (42) and an outlet (43); (5) designates a surrounding shell made of an insulating material which is connected to the body (1) so as to surround the movable contact (4) and which forms a nozzle and an arc space in it; (11) designates an arcing electrode whose one end is electrically connected to the below mentioned coil and whose other end is disposed on the body (1) so as to face the movable contact (4); (12) designates a coil whose one end is electrically connected to the body (1) and whose other end is electrically connected to the arcing electrode (11).

In said structure of the embodiment, the circuit current is usually passed through the circuit of body (1)-fixed contact (3)-movable contact (4).

When the departing instruction is given to a driving device (not shown) and the driving device starts the operation to descend the movable contact (4) interlocking to the driving device begins. The movable contact (4) descends for a wiping distance to the fixed contact (3) to detach the contacts (3), (4) whereby the current is commutated between the movable contact (4) and the arcing electrode (11) and accordingly, the current is passed through the circuit of body (1)-coil (12)-arcing electrode (11)-movable contact (4) whereby the coil (8) is excited by the commutated current and the arcing electrode (11) is magnetized to form the magnetic field in the arc space and the part is in the closing condition by the arc.

The magnetic field crosses the arc to the result mainly in a severe arc turning force around he arcing point whereby the arc is extended and the diffusion of arc energy in the arc space is promoted to rise the temperature in the arc space and the arc voltage is raised by the arc itself to increase the arc energy input and the pressurizing effect by the arc in the chamber (2) is improved. The form of the arc is varied in zig-zag form in the arc space.

The movable contact (4) descends further whereby the pressure in the chamber (2) is rapidly raised to the pressure required for the arc extinction even in the zone of relatively small arc current.

When the movable contact (4) descends further, the chamber (2) is opened through the outlet (43). In the next time decreasing the arc current to zero, the arc is extinguished by the effective puffing and cooling effects caused by releasing the pressurized fluid in the chamber (2).

Thus, the arc is in the zig-zag form in the arc space, the puffing effect is improved by the effect of the cross releasing flow and it effects to break the arc locus to extinguish the arc rapidly and to give the characteristic for withstanding to high restriking voltage.

Incidentally the arcing electrode is formed by a porcelain material and the lower end (the part facing the movable contact (4)) is formed in a desirable shape, whereby the distribution of the magnetic field in the arc space can be varied as desired.

Figure 5:
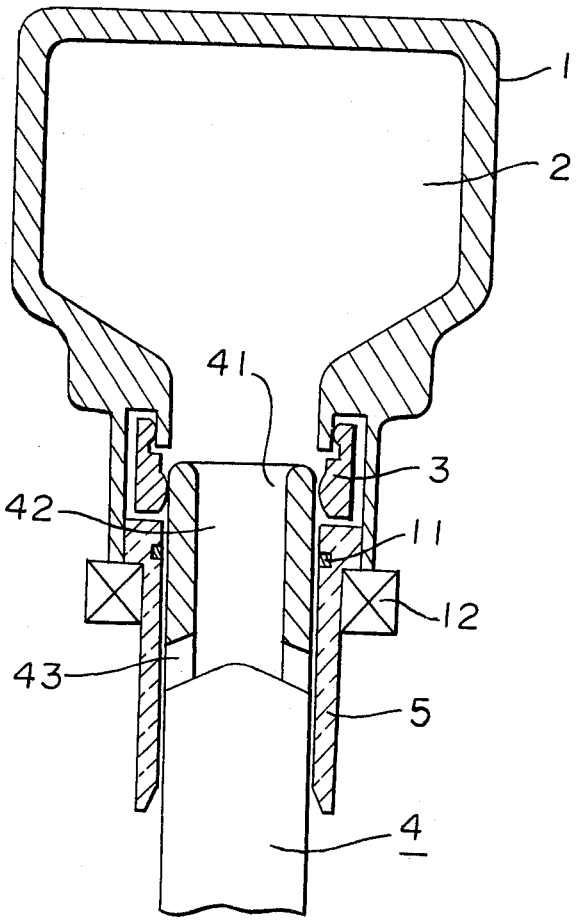
FIG. 5 is a sectional view of an important part of a fourth embodiment of the present invention.

The fourth embodiment of the present invention is shown in FIG. 5.

In FIG. 5, the arcing electrode (11) (third electrode) is disposed on the inner surface of the surrounding shell (5) near the fixed contact (3), and a coil (12) is disposed on the outer surface of the surrounding shell (5) and one end of the coil (12) is electrically connected to the same circuit with that of the fixed contact and the other end of the coil (12) is electrically connected to the arcing electrode (11).

In the structure, the same arc extinguishing operation as that of FIG. 4 can be attained.

In accordance with this embodiment, the structure for directly forming the magnetic field in the arc space by the coil (12) can be simplified.

Figure 6:
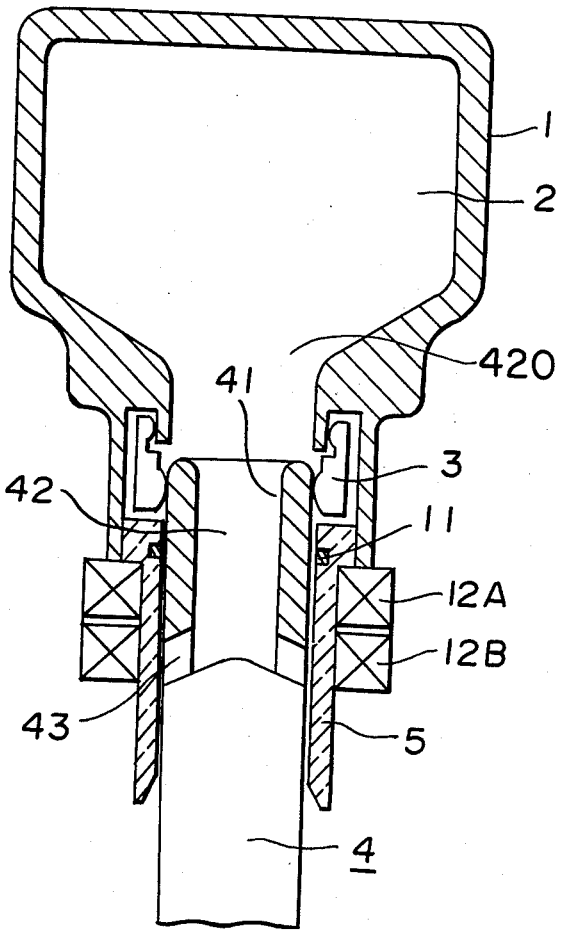
FIG. 6 is a sectional view of an important part of a fifth embodiment of the present invention.
Figure 7:
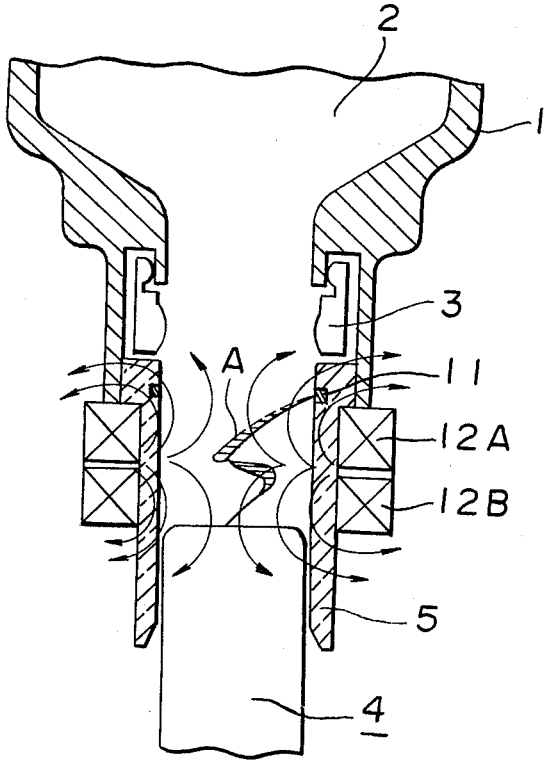
FIG. 7 is a sectional view of an important part for illustrating the operation of the circuit interrupter of FIG. 6.

The fifth embodiment of the present invention is shown in FIG. 6.

In FIG. 6, the reference numeral (1) designates a body of the circuit interrupter equipped in a container (not shown) filled with a fluid for arc extinction e.g. $SF_6$ gas and (2) designates a chamber which stores the fluid for arc extinction and has suitable volumetric space for temporarily storing the pressurized fluid formed by a pressurizing effect of arc; (3) designates a fixed contact disposed in the body (1) and separated from the chamber 2 by a passage 420; (4) designates a movable contact which is disposed to be detachable to the fixed contact (3) and which comprises an inlet (41) for the fluid, a passage (42) and an outlet (43); (5) designates a surrounding shell made of an insulating material which is connected to the body (1) so as to surround the movable contact (4) and which forms a nozzle and an arc space in it; (11) designates a third electrode of an arcing electrode which is disposed on the inner surface of the surrounding shell (11) near the fixed contact (3); (12A), (12B) respectively designate coils whose one end is connected to the same circuit of the fixed contact (3) and whose other end is connected to the third electrode (11) to form a magnetic fields to the opposite direction depending upon the current and which are disposed on the outer surface of the surrounding shell (5).

In said structure of the embodiment, the departing instruction is given to a driving device (not shown) and the driving device starts the operation to descend the movable contact (4) interlocked to the driving device. The movable contact (4) descends for a wiping distance to the fixed contact (3) to detach the contacts (3), (4) whereby the arc is formed and the part is in the closing condition by the arc.

The movable contact (4) descends further to extend the arc whereby the arc voltage is increased to rise the pressure in the chamber (2).

When the movable contact (4) is passed through the third electrode (11), the arc is immediately shifted between the movable contact (4) (4) and the third electrode (11) whereby the arc is commutated in the magnetic field shifting circuit which comprises the coils (12A), (12B) having suitable impedances and the magnetic field is formed in the arc space.

In the magnetic field, when the clockwise turning force is applied at the upper end of the coil (12A), the counter-clockwise turning force is applied between the coils (12A), (12B) as shown in FIG. 6 and the clockwise turn force is applied at the lower end of the coil (12B) to the arc A. Accordingly, the turning forces in the axial direction are alternatively applied to the arc space to extend the arc in zig-zag form in the arc space whereby the fluid is uniformly heated and the pressurizing effect in the chamber (2) is high even though the arc current is small and the arc is magnetically interrupted by the coils (12A), (12B).

When the movable contact (4) descends further, the outlet (43) is passed through the end of the surrounding member (5) whereby the pressurized fluid in the chamber (2) is discharged through the outlet (43). When the arc current is zero, the arc is rapidly extinguished by severe puffing effect by the fluid. Thus, the magnetic field effect is applied to the arc and the arc is extended to cross to the pressurized fluid released whereby short arcing time and excellent striking voltage characteristics can be attained though the arc current is small to be small flow of the discharged fluid.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A circuit interrupter comprising:

a housing;

a chamber in said housing forming a volumetric space for storing a fluid for arc extinction;

a fixed contact in said housing;

a movable contact in said housing, said movable contact initially contacting said fixed contact;

means for moving said movable contact to form an arc;

an arc space in said housing for said arc, said arc space being connected to said chamber by a first passage;

a second passage in said housing for discharging fluid from said chamber out of said housing via said arc chamber; and means for forming in said arc space a magnetic field, transverse to the direction of movement of said movable electrode, said means for forming comprising an arcing electrode in said arc space and at least two coils surrounding said arc space on said housing and connected between said arcing electrode and said fixed electrode, said at least two coils forming at least two transverse magnetic fields of opposite polarity, whereby said arc is extinguished.

2. A circuit interrupter according to claim 1 wherein said coils are disposed around a surrounding shell for surrounding the arc space.

3. A circuit interrupter according to claim 1 wherein the arcing electrode is disposed within the field of said coil on the inner surface of an insulating surrounding shell for surrounding the arc space near the fixed contact.

4. A circuit interrupter according to claim 1 wherein the arcing electrode is disposed to be magnetized as the result of an excitation of the coil.

5. A circuit interrupter according to claim 1 wherein the coils are disposed about the axial direction of the arc so as to surround the arc space.

6. A circuit interrupter according to claim 1 wherein said second passage is formed on one of the contacts and an insulating surrounding shell having a length for maintaining said second passage in the closing condition until moving the movable contact for a specific distance.

7. A circuit interrupter according to claim 1 wherein second passage is formed to be hollow shape in a part of the movable contact.

* * * * *